US005415208A

United States Patent [19]

Wu

[11] Patent Number: 5,415,208

[45] Date of Patent: May 16, 1995

[54] AUXILIARY SPRING BENDING MACHINE

[76] Inventor: Chin-Tu Wu, c/o Hung Hsing Patent Service Center, P.O. Box 55-1670, Taipei (104), Taiwan, Prov. of China

[21] Appl. No.: 164,434

[22] Filed: Dec. 9, 1993

[51] Int. Cl.[6] ..... B21F 35/02

[52] U.S. Cl. ..... 140/103

[58] Field of Search ..... 72/137; 140/103

[56] References Cited

U.S. PATENT DOCUMENTS 3,205,917 9/1965 Vanhulen ..... 140/103
3,721,276 3/1973 Lamperti ..... 140/103
4,485,851 12/1984 Takumi ..... 140/103

*Primary Examiner*—Lowell A. Larson

[57] ABSTRACT

A spring bending machine includes: a take-up device for taking up a spring made from an automatic spring-making machine, an orienting device for rotating a spring hook end to a vertical position, a vice reciprocatively mounted on a frame having a pair of jaws for clamping the spring to be bent to project the spring hook end outwardly from the two jaws, and a bending tool reciprocatively mounted on the frame for bending the vertically-oriented spring hook end to be horizontaly oriented, and a driving device for driving the vice and the bending tool for their respective clamping and bending operation.

4 Claims, 7 Drawing Sheets

AUXILIARY SPRING BENDING MACHINE

BACKGROUND OF THE INVENTION

U.S. Pat. No. 4,947,670 entitled "Universal Automatic Spring-making Machine" issued to the same inventor of this application disclosed an automatic spring-making machine including a plurality of forming tools reciprocatively sliding in a plurality of tool guides radially disposed on a panel so that a spring wire led through a central chuck of the machine will be automatically formed as diversified shapes of spring products by the forming tools for conveniently and efficiently making springs.

Since all forming tools of such an automatic spring-making machine are pre-fixed on the machine frame, when it is intended to produce a commercial available "tension spring" having two horizontal hook portions S1, S2, it is necessary to further bend a hook portion at a spring end such as from a right-angle hook portion S2 as shown in solid line in FIG. 8 to a horizontally-positioned hook portion (dotted line) to form such two horizontal hook portions S1, S2 for obtaining the tension spring.

Therefore, the present inventor continues to invent the present auxiliary spring bending machine for bending a spring end portion of a spring already produced by the automatic spring-making machine.

SUMMARY OF THE INVENTION

The object of the present invention is to provide a spring bending machine including: a take-up device for taking up a spring made from an automatic spring-making machine, an orienting device for rotating a spring hook end to a vertical position, a vice reciprocatively mounted on a frame having a pair of jaws for clamping the spring to be bent to project the spring hook end outwardly from the two jaws, a bending tool reciprocatively mounted on the frame for bending the vertically-oriented spring hook end to be horizontally oriented, and a driving device for driving the vice and the bending tool for their respective clamping and bending operation.

DETAILED DESCRIPTION

Figure 1:
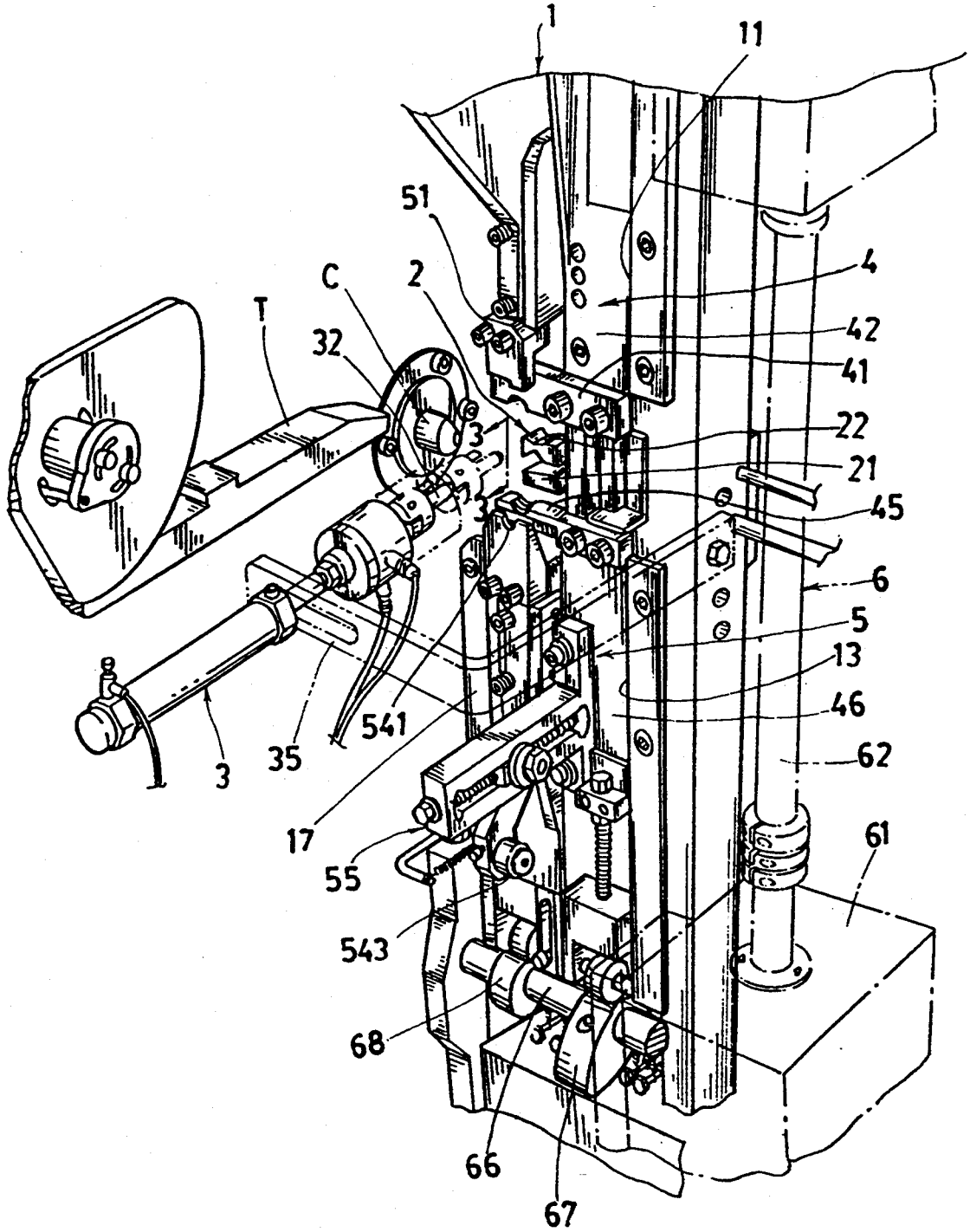
FIG. 1 is a perspective view of the present invention.

As shown in FIGS. 1-7, the present invention comprises: a frame 1, a take-up means 2, an orienting means 3, a vice means 4, a bending tool means 5, and a driving means 6.

Figure 2:
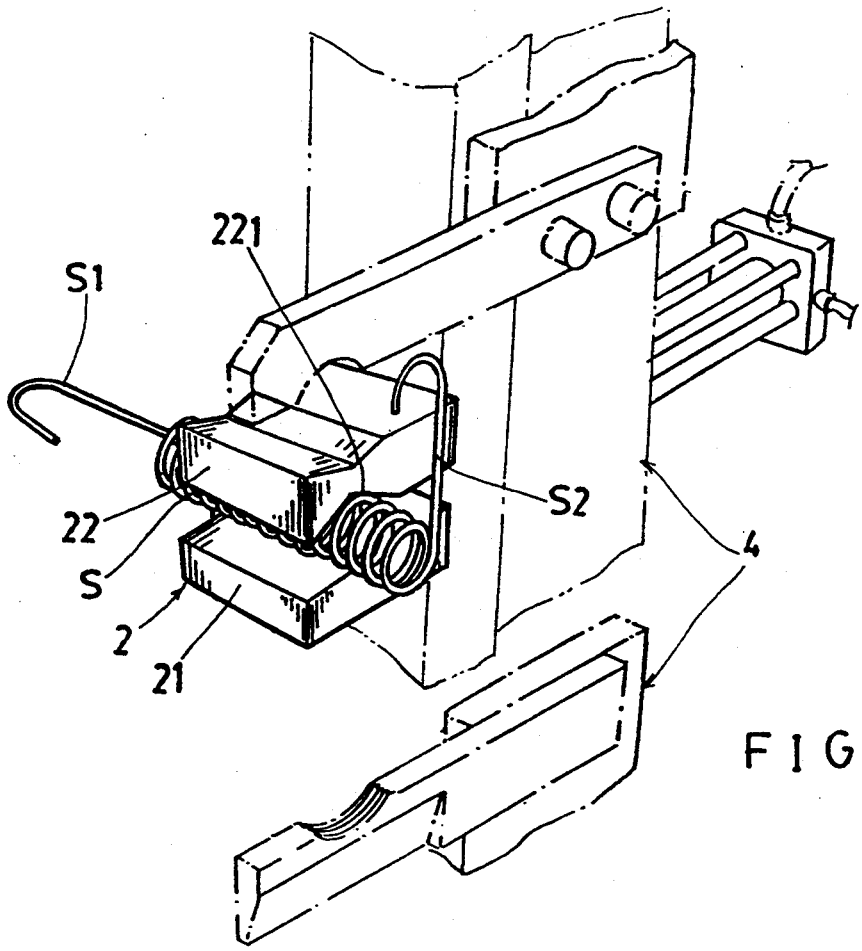
FIG. 2 shows a take up means of the present invention.

The take-up means 2 as shown in FIG. 2 includes: a lower clip member 21, and an upper clip member 22 having a triangular shaped recess 221 recessed in the upper clip member 22 for receiving a spring S in the triangular-shaped recess 221 for holding the spring S between the two clip members 21, 22 when taking up a finished spring S from a chuck C of an automatic spring-making machine when formed by the tools T of the spring making machine as shown in FIG. 1. The two clip members 21, 22 may be reciprocatively slidably held on the frame 1 by a chuck means (not shown).

Figure 3:
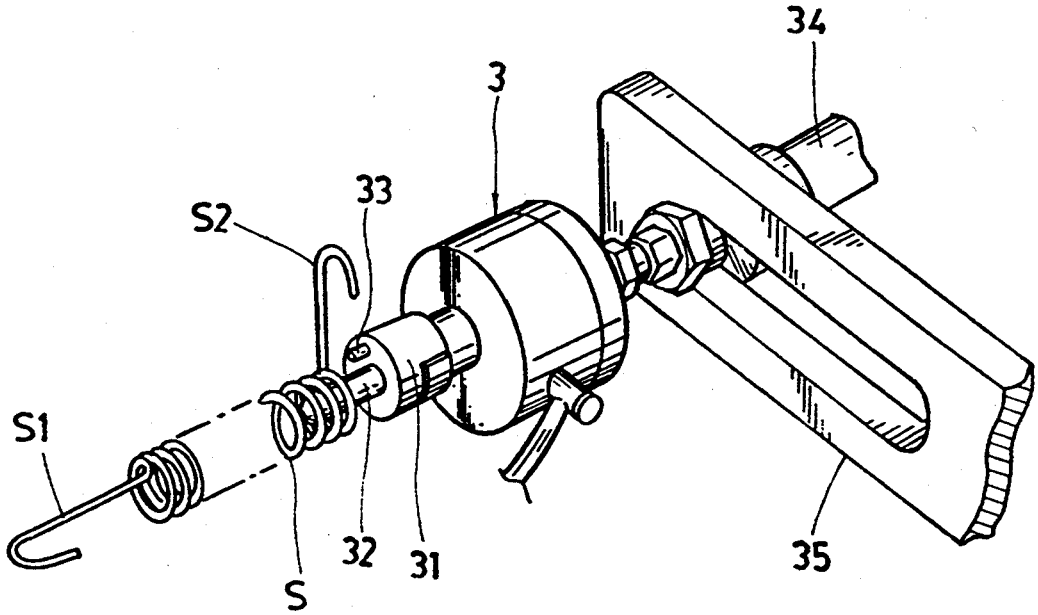
FIG. 3 shows an orienting means of the present invention when viewed from 3—3 direction of FIG. 1.
Figure 4:
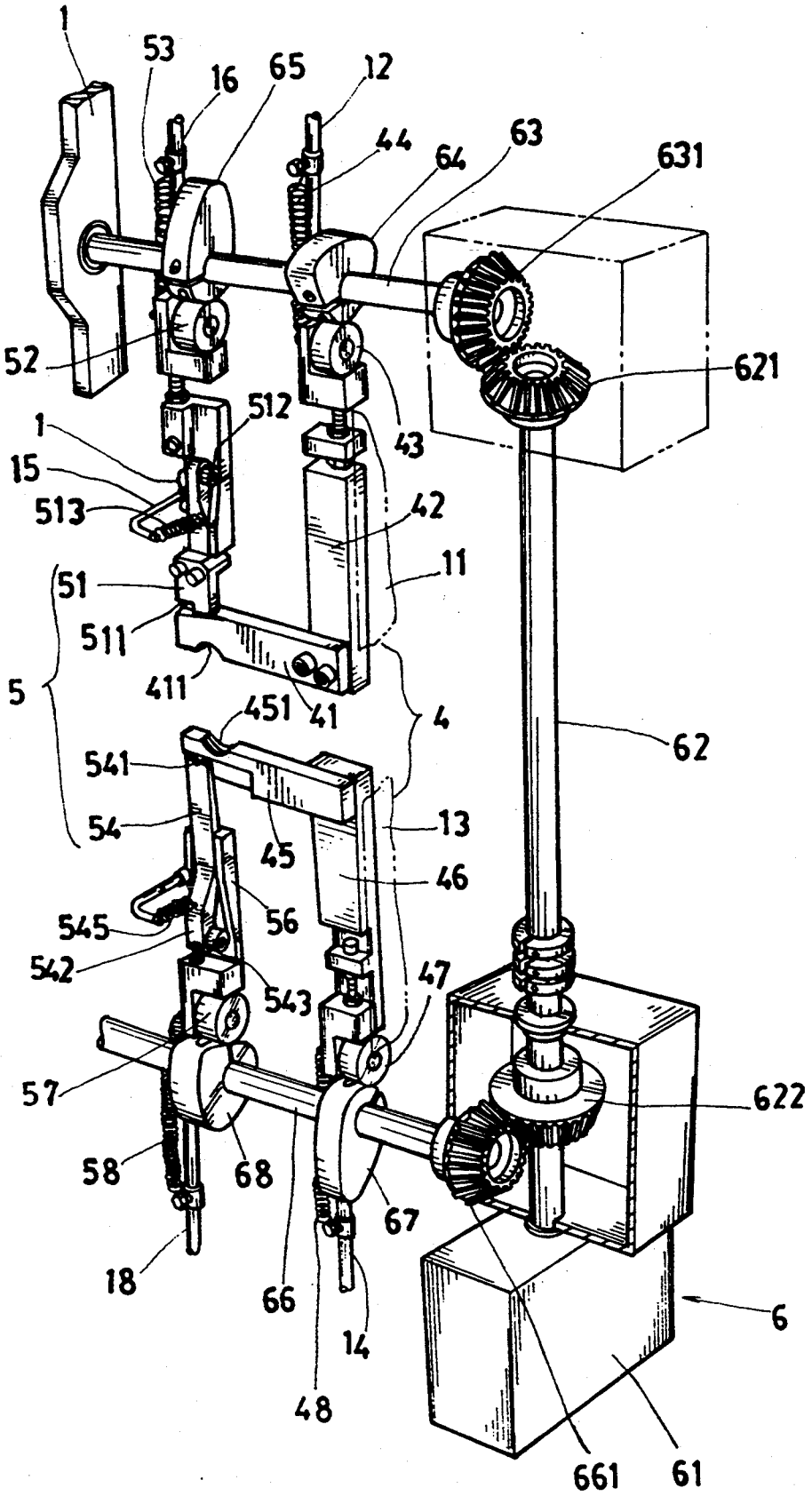
FIG. 4 is a perspective illustration showing a vice means, a bending tool means and a driving means of the present invention.
Figure 5:
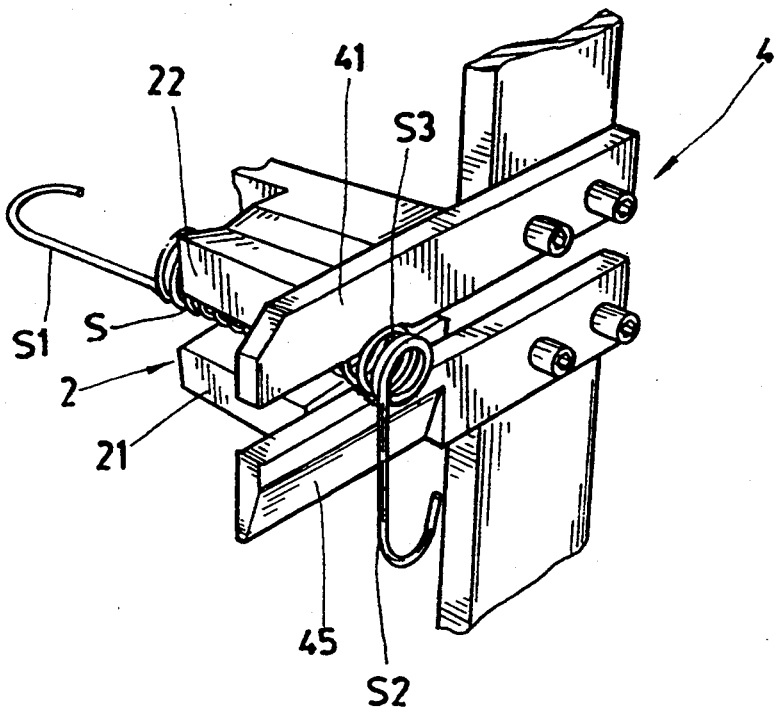
FIG. 5 shows a spring to be bent when clamped by the vice means and the take-up means of the present invention.
Figure 6:
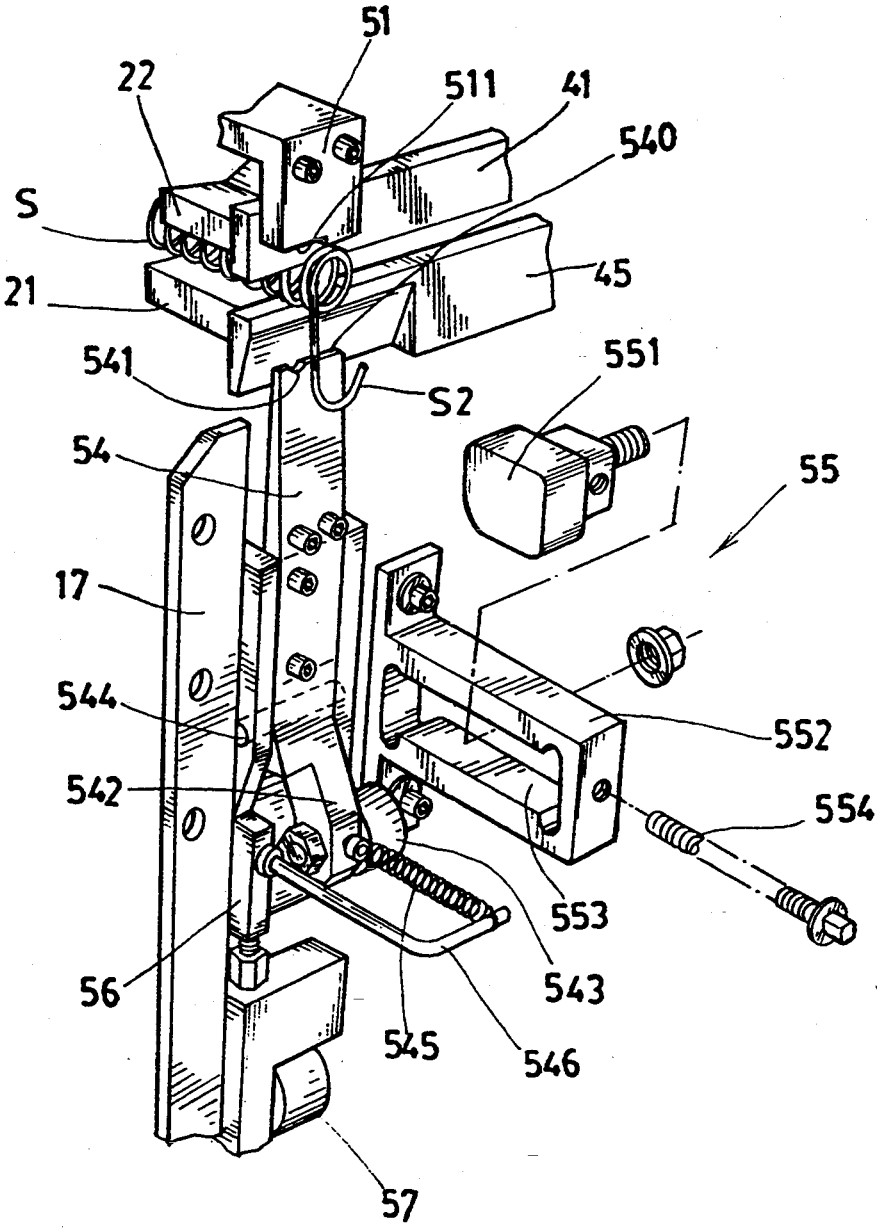
FIG. 6 is a partial enlarged view of the bending tool means.
Figure 7A:
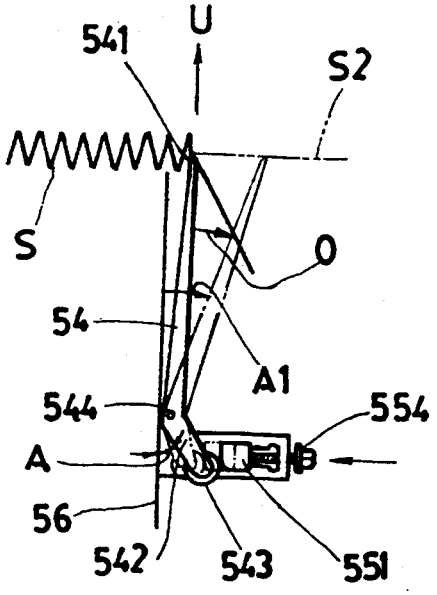
FIG. 7A is a simple illustration showing an adjustment of the bending angle of the present invention.
Figure 7:
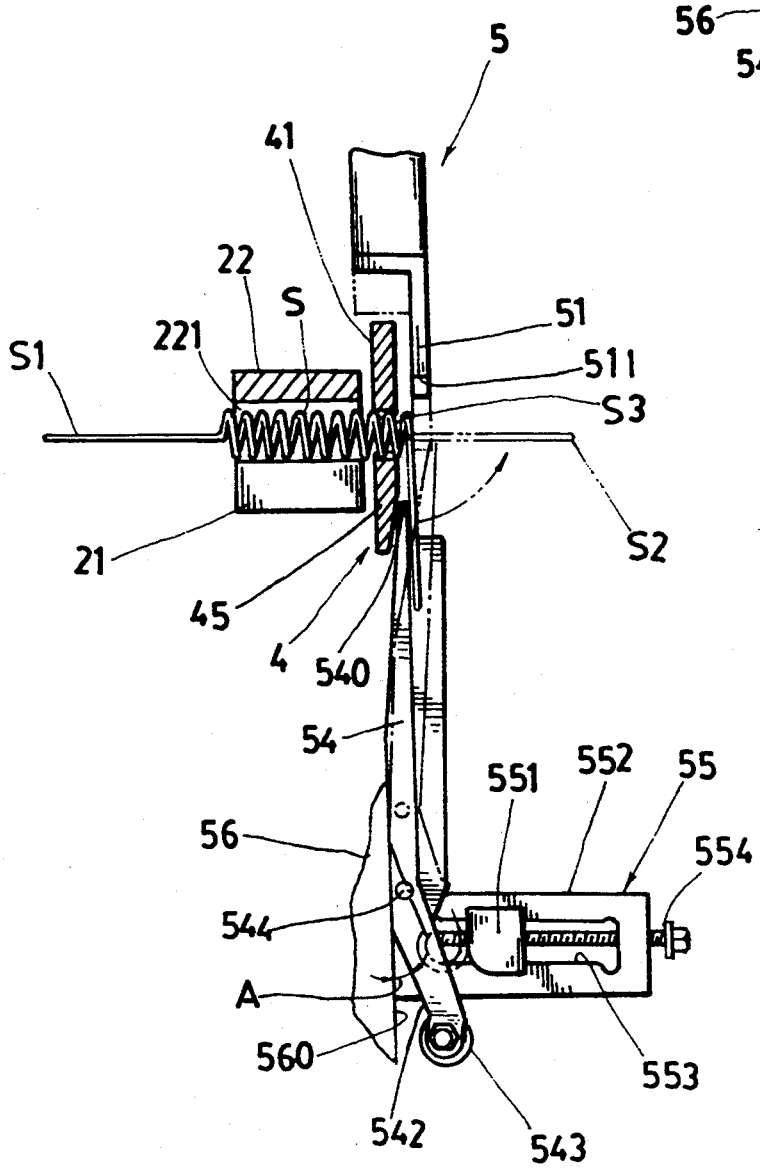
FIG. 7 is an illustration showing a bending operation in accordance with the present invention.

The orienting means 3 as shown in FIG. 3 includes: a rotating head portion 31 having a spindle 32 protruding from a center portion of the head portion 31 frontwardly to insert a spring coil of the spring S to be bent, a pusher stem 33 protruding from a peripheral portion of the head portion 31 frontwardly to rotatably push a springhook end S2 downwardly to be vertically oriented as shown in FIG. 5 ready for bending the vertically-oriented spring hook end S2 to be horizontally oriented as shown in FIG. 7 (dotted line), a control means 34 for controlling reciprocative forwarding of the rotating head portion 31 for inserting the spindle 32 into the spring S to be bent and for controlling the rotation of the stem 33 for orienting the spring hook end S2 vertically, and for retracting the head portion 31 after rotatably positioning the spring S to be bent, and a bracket 35 for securing the orienting means 3 to the frame 1.

The vice means 4 includes: an upper jaw 41 having an upper spring recess 411 formed with coil threads in the upper recess 411 for engaging a coil spring, an upper cantilever 42 perpendicularly secured with the upper jaw 41 and reciprocatively held in an upper guide 11 longitudinally formed on the frame 1, a first upper roller 43 rotatably secured on an upper portion of the upper cantilever 42 and resiliently hanged to a first upper retainer 12 on the frame 1 by a first upper restoring spring 44 with the first upper roller 43 eccentrically driven by a first upper cam 64 secured on an upper cam shaft 63 driven by the driving means 6 for reciprocatively moving the upper jaw 41; a lower jaw 45 having a loser spring recess 451 formed with coil threads 451 in the lower recess 451 for cooperatively clamping the spring S with the upper recess 411 of the upper jaw 41, a lower cantilever 46 perpendicularly secured with the lower jaw 45 and reciprocatively held in a lower guide 13 on the frame 1, a first lower roller 47 rotatably secured on a lower portion of the lower cantilever 46 and resiliently retained to a first lower retainer 14 by a first lower restoring spring 48 with the first lower roller 47 eccentrically driven by the driving means 6 for reciprocatively moving the lower jaw 45, the upper and the lower jaws 41, 45 cooperatively clamping the spring S as driven by the driving means 6 for subsequently bending operation by the bending tool means 5, with the upper jaw 41 and lower jaw 45 positioned adjacent to the take-up means 2 for clamping the spring S sent from the take-up means 2.

The bending tool means 5 includes: an anvil member 51 having a second upper roller 52 rotatably secured to an upper portion of the upper anvil member 51 resiliently hanged on a second upper retainer 16 on an upper portion of the frame 1 by a second upper restoring spring 53, with the second upper roller 52 eccentrically driven by a second upper cam 65 secured on the upper cam shaft 63 driven by the driving means 6 for reciprocatively moving the anvil member 51; a bending lever 54 operatively biased upwardly outwardly by a lever biasing actuator 55 secured on the frame 1 for cooperatively bending a spring hook end S2 of the spring S clamped between the two jaws 41, 45 of the vice means 4, and a lever holder 56 pivotally secured with the bending lever 54 and slidably held in a lever guide 17 in a lower portion of frame 1 having a second lower roller 57 rotatably secured to a lower portion of the lever holder 56 resiliently retained to a seocnd lower retainer 18 of the frame 1 by a second lower restoring spring 58, with the second lower roller 57 eccentrically driven by a second lower cam 68 secured to the lower cam shaft 66 driven by the driving means 6 for reciprocatively moving the bending lever 54.

The driving means 6 includes: a driving motor 61 having a transmission shaft 62 vertically protruding upwardly from the driving motor, the upper cam shaft 63 having an upper follower bevel gear 631 engageable with an upper driving bevel gear 621 formed on an upper end of the transmission shaft 62 for respectively rotating the first upper cam 64 and the second upper cam 65 axially and juxtapositionally mounted on the upper cam shaft 63 as driven by the transmission shaft 62 and the driving motor 61, and a lower cam shaft 66 having a lower follower bevel gear 661 engageable with a lower driving bevel gear 622 formed on a lower portion of the transmission shaft 62 for respectively rotating the first lower cam 67 and the second lower cam 68 axially and juxtapositionally mounted on the lower cam shaft 66 as driven by the transmission shaft 62 and the driving motor 61, with the first upper cam 64 and the first lower cam 67 cooperatively eccentrically driving the upper and lower jaws 41, 45 for clamping the spring S therebetween ready for bending the spring hook end S2; and with the second upper cam 65 and the second lower cam 68 cooperatively eccentrically driving the anvil member 51 and the bending lever 54 for bending the spring hook end S2 to be horizontally oriented or to be a sloping angle from a vertically oriented hook end S2 of the spring S.

The anvil member 51 of the bending tool means 5 includes: a coil end recess 511 having coil threads recessed therein for retaining a coil end portion S3 of the spring S to bear against a bending movement acting upon the spring hook end S2 as upwardly bent by the bending lever 54 as shown in FIG. 7, and upper guiding roller 512 rotatably slidably held on an upper portion of the frame 1, and an anvil restoring spring 513 retained to an anvil spring retainer 15 formed on an upper portion of the frame 1 for restoring the anvil member 51 to its original position after downwardly moving the anvil member 51 as driven by the driving means 6.

The bending lever 54 includes: a wire notch 541 recessed in an upper bending end 540 of the lever 54 for engageably holding the spring hook end S2 of spring end wire (or rod), a depression portion 542 protruding downwardly outwardly from a pivot 544 for pivotally securing the lever 54 on the holder 56 to define an acute angle A from the flat surface 560 of the lever holder 56 to be operatively depressed and biased by the lever biasing actuator 55 as shown in FIGS. 7, 7A, a biasing roller 543 rotatably mounted on the depression portion 542 to be actuated by the biasing actuator 55, and a lever restoring spring 545 secured to the lever holder 56 by a lever spring retainer 546 for normally restoring the lever restoring spring 545 to inwardly retract the lever 54 towards the lever holder 56 when downwardly moving the lever 14 from the lever biasing actuator 55 ready for a next bending operation of the spring S.

The lever biasing actuator 55 includes: a biasing block 551 movably secured in a sliding groove 553 horizontally formed in a block holder 552 secured to a lower portion of the frame 1 to bias the depression portion 542 of the bending lever 54 about the pivot 544 (or fulcrum) to outwardly upwardly move the upper bending end 540 of the lever 54 to bend a vertically-oriented spring hook end S2 upwardly or horizontally, and an adjusting bolt 554 rotatably mounted in the block holder 552 for moving the biasing block 551 inwardly towards the flat surface 560 of the block holder 56 or outwardly from the flat surface 560 of the block holder 56, thereby adjusting a biasing angle A1 as shown in FIG. 7A when upwardly moving (U) the lever holder 56 and the bending lever 54 for bending the spring hook end S2. That is, a more inwardly adjusting of the biasing block 551 towards the flat surface 560 of the block holder 56, a bigger bending angle A1 as outwardly biasing (O) the upper bending end 540 of the lever 54 can be achieved, thereby horizontally orienting the spring hook end S2.

In operating the spring bending machine of this invention, the spring S from the chuck C of the spring-making machine is transferred to the take-up means 2 and the spring hook end S2 is downwardly oriented by the orienting means 3. Then, the spring S is clamped by the two jaws 41, 45 of the vice means 4, and the bending lever is pushed upwardly since the second lever roller 57 is eccentrically driven by the second cam 68 on the lower cam shaft 66 and will be biased while the depression portion 542 of the bending lever 54 is retarded by the biasing block 551 of the lever biasing actuator 55 to upwardly outwardly bias the upper bending end 540 of the lever to bend the spring hook end S2 to be horizontally oriented to form a "tension spring" having two horizontally-oriented hook ends S1, S2 as shown in FIG. 8 while the coil end portion S3 of the spring S is bearing against the anvil member 51 downwardly driven by the second upper cam to urge the second upper roller 52 and the anvil member 51 downwardly towards the lower bending lever 54.

Figure 8:
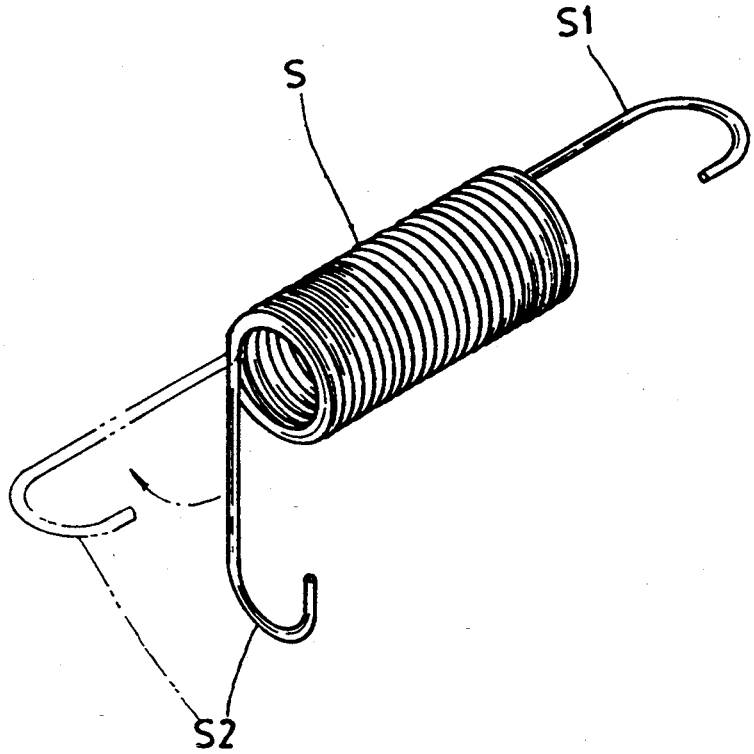
FIG. 8 shows a spring to be bent in accordance with the present invention.

Although, the spring hook end S2 can be bent to be horizontally oriented as shown in FIG. 8 by the present invention. However, other bending angles of the spring ends may be modified, not limited, in accordance with the present invention.

The bending operation sequences as above-mentioned may be controlled by a pregrammed computer-controlled mechanism for performing an automatic spring bending operation therefor.

I claim:

1. A spring bending maching comprising:

a frame (1);

a take-up means (2) operatively taking up and holding a spring (S) made from a spring-making machine;

an orienting means (3) secured on said frame (1) and operatively rotating a spring hook end (S2) of the spring (S) held on said take-up means (2) to a specific orientation ready for bending of the spring hook end (S2);

a vice means (4) reciprocatively mounted on said frame (1) and operatively clamping the spring (S) to be bent to project the spring hook end (S2) to be bent outwardly from the vice means (4);

a bending tool means (5) reciprocatively mounted on said frame (1) and operatively bending the spring hook end (S2) of the spring (S) to a desired orientation; and a driving means (6) for driving said vice means (4) for clamping the spring (S), and for driving said bending tool means (5) for bending the spring hook end (S2);

said take-up means (2) including: a lower clip (21), and an upper clip member (22) having a triangular shaped recess (221) recessed in the upper clip member (22) for receiving the spring (S) in the triangular-shaped recess (221) for holding the spring (S) between the two clip members (21), (22) when taking up the spring (S) made from the spring-making machine, said two clip members (21), (22) reciprocatively slidably held on the frame (1); said orienting means (3) including: a rotating head portion (31) having a spindle (32) protruding from a center portion of the head portion (31) frontwardly to insert a spring coil of the spring (S) to be bent, a pusher stem (33) protruding from a peripheral portion of the head portion (31) frontwardly to rotatably push the spring hook end (S2) downwardly to be vertically oriented ready for bending the spring hook end (S2) to be horizontally oriented, a control means (34) for controlling reciprocative forwarding of the rotating head portion (31) for inserting the stem (33) into the spring (S) to be bent, for rotating the stem (33) to orient the spring hook end downwardly and for retracting the head portion (31) after rotatably positioning the spring (S) to be bent, and a bracket (35) for securing the orienting means (3) to the frame (1);

said vice means (4) including: an upper jaw (41) having an upper spring recess (411) formed with coil threads in the upper recess (411) for engaging a coil spring, an upper cantilever (42) perpendicularly secured with the upper jaw (41) and reciprocatively held in an upper guide (11) longitudinally formed on the frame (1), a first upper roller (43) rotatably secured on an upper portion of the upper cantilever (42) and resiliently hanged to a first upper retainer (12) on the frame (1) by a first upper restoring spring (44) with the first upper roller (43) eccentrically driven by a first upper cam (64) secured on an upper cam shaft (63) driven by the driving means (6) for reciprocatively moving the upper jaw (41); a lower jaw (45) having a lower spring recess (451) formed with coil threads (451) in the lower recess (451) for cooperatively clamping the spring (S) with the upper recess (411) of the upper jaw (41), a lower cantilever (46) perpendicularly secured with the lower jaw (45) and reciprocatively held in a lower guide (13) on the frame (1), a first lower roller (47) rotatably secured on a lower portion of the lower cantilever (46) and resiliently retained to a first lower retainer (14) by a first lower restoring spring (48) with the first lower roller (47) eccentrically driven by a first lower cam (67) secured on a lower cam shaft (66) driven by the driving means (6) for reciprocatively moving the lower jaw (45), the upper and the lower jaws (41), (45) cooperatively clamping the spring (S) as driven by the driving means (6) for subsequently bending operation by the bending tool means (5), with the upper jaw (41) and lower jaw (45) positioned adjacent to the take-up means (2) for clamping the spring (S) from the take-up means (2); said bending tool means (5) including: an anvil member (51) having a second upper roller (52) rotatably secured to an upper portion of the upper anvil member (51) resiliently hanged on a second upper retainer (16) on an upper portion of the frame (1) by a second upper restoring spring (53), with the second upper roller (52) eccentrically driven by a second upper cam (65) secured on the upper cam shaft (63) driven by the driving means (6) for reciprocatively moving the anvil member (51); a bending lever (54) operatively biased upwardly outwardly by a lever biasing actuator (55) secured on the frame (1) for cooperatively bending the spring hook end (S2) of the spring (S) clamped between the two jaws (41), (45) of the vice means (4), and a lever holder (56) pivotally secured with the bending lever (54) and slidably held in a lever guide (17) in a lower portion of frame (1) having a second lower roller (57) rotatably secured to a lower portion of the lever holder (56) resiliently retained to a second lower retainer (18) of the frame (1) by a second lower restoring spring (58), with the second lower roller (57) eccentrically driven by a second lower cam (68) secured to the lower cam shaft (66) driven by the driving means (6) for reciprocatively moving the bending lever (54); and said driving means (6) including: a driving motor (61) having a transmission shaft (62) vertically protruding upwardly from the driving motor (61), the upper cam shaft (63) having an upper follower bevel gear (631) engageable with an upper driving bevel gear (621) formed on an upper end of the transmission shaft (62) for respectively rotating the first upper cam (64) and a second upper cam (65) axially and juxtapositionally mounted on the upper cam shaft (63) as driven by the transmission shaft (62) and the driving motor (61), and a lower cam shaft (66) having a lower follower bevel gear (661) engageable with a lower driving bevel gear (622) formed on a lower portion of the transmission shaft (62) for respectively rotating the first lower cam (67) and a second lower cam (68) axially and juxtapositionally mounted on the lower cam shaft (66) as driven by the transmission shaft (62) and the driving motor (61), with the first upper cam (64) and the first lower cam (67) cooperatively eccentrically driving the upper and lower jaws (41), (45) for clamping the spring (S) therebetween ready for bending the spring hook end (S2); and with the second upper cam (65) and the second lower cam (68) cooperatively eccentrically driving the anvil member (51) and the bending lever (54) for bending the spring hook end (S2) to be horizontally oriented or to be a sloping angle from a vertically oriented hook end (S2) of the spring (S).

2. A spring bending machine according to claim 1, wherein said anvil member (51) of the bending tool means (5) includes: a coil end recess (511) having coil threads recessed therein for retaining a coil end portion (S3) of the spring (S) to bear against a bending movement acting upon the spring hook end (S2) as upwardly bent by the bending lever (54), an upper guiding roller (512) rotatably slidably held on an upper portion of the frame (1), and an anvil restoring spring (513) retained to an anvil spring retainer (15) formed on an upper portion of the frame (1) for restoring the anvil member (51) to its original position after downwardly moving the anvil member (51) as driven by the driving means (6).

3. A spring bending machine according to claim 2, wherein said bending lever (54) includes: a wire notch (541) recessed in an upper bending end (540) of the lever (54) for engageably holding the spring hook end (S2) of a spring end wire, a depression portion (542) protruding downwardly outwardly from a pivot (544) for pivotally securing the lever (54) on the holder (56) to define an acute angle A from a flat surface (560) of the lever holder (56) to be operatively depressed and biased by the lever biasing actuator (55), a biasing roller (543) rotatably mounted on the depression portion (542) to be actuated by the biasing actuator (55), and a lever restoring spring (545) secured to the lever holder (56) by a lever spring retainer (546) for normally restoring the lever restoring spring (545) to inwardly retract the lever (54) towards the lever holder (56) when downwardly moving the lever (14) from the lever biasing actuator (55) ready for a next bending operation of the spring S.

4. A spring bending machine to claim 3, wherein said lever biasing actuator (55) includes: a biasing block (551) movably secured in a sliding groove (553) horizontally formed in a block holder (552) secured to a lower portion of the frame (1) to bias the depression portion (542) of the bending lever (54) about the pivot (544) to outwardly upwardly move an upper bending end of the lever (54) to bend a vertically-oriented spring hook end (S2) upwardly or horizontally, and an adjusting bolt (554) rotatably mounted in the block holder (552) for moving the biasing block (551) inwardly towards the flat surface (560) of the block holder (56) or outwardly from the flat surface (560) of the block holder (56), thereby adjusting a biasing angle when upwardly moving the lever holder (56) and the bending lever (54) for bending the spring hook end (S2).

* * * * *